US011459925B2

(12) United States Patent
Fukuda

(10) Patent No.: US 11,459,925 B2
(45) Date of Patent: Oct. 4, 2022

(54) EXHAUST GAS PURIFICATION STRUCTURE AND OUTBOARD MOTOR

(71) Applicant: HONDA MOTOR CO., LTD., Tokyo (JP)

(72) Inventor: Yoshihiko Fukuda, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/417,844

(22) PCT Filed: Dec. 18, 2019

(86) PCT No.: PCT/JP2019/049631
§ 371 (c)(1),
(2) Date: Jun. 24, 2021

(87) PCT Pub. No.: WO2020/137748
PCT Pub. Date: Jul. 2, 2020

(65) Prior Publication Data

US 2022/0126965 A1 Apr. 28, 2022

(30) Foreign Application Priority Data

Dec. 28, 2018 (JP) ..... JP2018-247365

(51) Int. Cl.
*F01N 3/04* (2006.01)
*F01N 3/02* (2006.01)
(Continued)

(52) U.S. Cl.
CPC ..... *F01N 3/046* (2013.01); *F01N 3/0205* (2013.01); *B63H 20/245* (2013.01);
(Continued)

(58) Field of Classification Search
CPC ..... F01N 3/046; F01N 2240/20; F01N 2260/024; F01N 2590/021
See application file for complete search history.

(56) References Cited

U.S. PATENT DOCUMENTS 5,433,073 A * 7/1995 Duret ..... F01N 3/2046 60/288
5,439,651 A * 8/1995 Kato ..... F01N 3/2839 440/89 R (Continued)

FOREIGN PATENT DOCUMENTS

JP 61-018009 5/1986

OTHER PUBLICATIONS

International Search Report and Written Opinion for International Application No. PCT/JP2019/049631 dated Feb. 19, 2020, 10 pages.

*Primary Examiner* — Jonathan R Matthias
(74) *Attorney, Agent, or Firm* — Amin, Turocy & Watson, LLP

(57) ABSTRACT

An exhaust gas purification structure of an outboard motor includes an exhaust gas pipe that has an exhaust gas passage through which exhaust gas of an engine can flow; and a catalyst that is provided in the exhaust gas passage and purifies the exhaust gas by allowing the exhaust gas to pass through the inside thereof. The exhaust gas pipe includes a coolant flow passage allowing a coolant that cools the exhaust gas to flow therethrough. An exhaust gas bypass passage allowing the exhaust gas to flow without passing through the catalyst is formed between the catalyst and an inner surface of the exhaust gas pipe forming the exhaust gas passage.

12 Claims, 10 Drawing Sheets

(51) Int. Cl.

| | |
|---|---|
| *B63H 20/24* | (2006.01) |
| *B63H 20/28* | (2006.01) |
| *F01N 13/18* | (2010.01) |
| *F01P 3/20* | (2006.01) |

(52) U.S. Cl.
CPC ..... *B63H 20/285* (2013.01); *F01N 3/04* (2013.01); *F01N 13/1805* (2013.01); *F01N 2240/02* (2013.01); *F01N 2240/20* (2013.01); *F01N 2260/024* (2013.01); *F01N 2590/021* (2013.01); *F01P 3/202* (2013.01)

(56) References Cited

U.S. PATENT DOCUMENTS

| | | | | |
|---|---|---|---|---|
| 7,264,520 | B1 * | 9/2007 | Taylor | F01P 11/08 440/88 HE |
| 2010/0261393 | A1 | 10/2010 | Kazuta | |
| 2011/0223819 | A1 * | 9/2011 | Kazuta | F01N 13/004 440/89 H |

* cited by examiner

EXHAUST GAS PURIFICATION STRUCTURE AND OUTBOARD MOTOR

TECHNICAL FIELD

The present invention relates to an exhaust gas purification structure that purifies exhaust gas of an internal combustion engine, and to an outboard motor in which the exhaust gas purification structure is loaded.

BACKGROUND ART

An outboard engine rotates a propeller to cause a ship body to progress, by burning fuel with an engine (internal combustion engine) to obtain a rotational drive force. Since this type of outboard motor is used for travel on the ocean or a river, the exhaust gas emission regulations are looser than those of an automobile or the like that travels on roads, but in recent years, due to environmental concerns, outboard motors are being developed in which are loaded exhaust gas purification structures that purify the exhaust gas of the engine. There is a desire to improve the exhaust gas purification function of such an exhaust gas purification structure while also arranging the catalyst that purifies the exhaust gas more compactly therein, in order to prevent the outboard motor itself from becoming larger due to an increase in the size of the engine.

For example, Japanese Patent Publication No. 61-018009 discloses a catalyst-holding section cooling structure (exhaust gas purification structure) in which the catalyst is installed in the exhaust gas passage of the outboard engine. This exhaust gas purification structure has a catalyst holding section provided in an exhaust gas pipe that is connected to a bottom end of an engine holder, the catalyst is held by this catalyst holding section, and a thermal insulation layer is arranged around the catalyst.

SUMMARY OF INVENTION

The catalyst of the exhaust gas purification structure can be activated by being raised to a certain temperature, to favorably purify the exhaust gas. However, when the catalyst reaches a high temperature of 1000° C. or more, a sintering phenomenon occurs easily and the activity (purification function) is greatly reduced. Therefore, there is a desire for an exhaust gas purification structure capable of suitably managing the temperature of the catalyst. In particular, there is a desire for an exhaust gas purification structure that improves the purification function by raising the temperature of the catalyst itself as much as possible when the engine begins operating, while preventing the temperature of the catalyst from becoming too high.

Specifically, the locations where the catalyst can be arranged are limited, e.g. the catalyst can be arranged at a location that is free of heat, but some of these locations are not suitable for an outboard motor. In an outboard motor, it is necessary to devise a way to increase the degree of freedom in the catalyst layout in order to improve assembly, removal, and maintainability.

The present invention has been devised in consideration of the exhaust gas purification technology described above, and it is an object of the present invention to provide an exhaust purification structure and an outboard motor with simplified assembly and maintenance, by making it possible to cool the catalyst with a simple structure and to easily remove the catalyst from the catalyst arrangement position. A further object of the present invention is to provide an exhaust purification structure and an outboard motor that can reduce deterioration of the catalyst by not allowing the entire exhaust gas to pass even during full operation.

In order to achieve the above object, a first aspect of the present invention is an exhaust gas purification structure of an outboard motor, the exhaust gas purification structure comprising an exhaust gas pipe including an exhaust gas passage through which exhaust gas of an internal combustion engine is allowed to flow; and a catalyst provided in the exhaust gas passage and configured to purify the exhaust gas by allowing the exhaust gas to pass through an inside thereof, wherein a coolant flow passage allowing a coolant that cools the exhaust gas to flow therethrough is provided in the exhaust gas pipe, and an exhaust gas bypass passage allowing the exhaust gas to flow without passing through the catalyst is formed between the catalyst and an inner surface of the exhaust gas pipe forming the exhaust gas passage.

In order to achieve the above object, a second aspect of the present invention is an outboard motor comprising the exhaust gas purification structure described above, the outboard motor further comprising a cooling structure configured to take in, through a water intake port, cooling water serving as the coolant and cool the exhaust gas by guiding the cooling water to the exhaust gas pipe.

By providing the coolant flow passage in the exhaust gas pipe, the exhaust gas purification structure and the outboard motor described above can favorably cool the catalyst inside the exhaust gas passage and the exhaust gas flowing through the exhaust gas passage. Accordingly, during maintenance or the like, a worker can easily touch the internal combustion engine or the exhaust gas pipe near the catalyst, easily remove the cooled catalyst, and smoothly perform assembly. Furthermore, by including the exhaust gas bypass passage in the exhaust gas purification structure, the catalyst is efficiently heated by the surrounding exhaust gas even when the coolant flows through the coolant flow passage of the exhaust gas pipe when the internal combustion engine is activated. Accordingly, the catalyst is quickly raised to a temperature suitable for purification of the exhaust gas. Furthermore, the exhaust gas bypass passage can reduce deterioration of the catalyst by not allowing the entire exhaust gas to pass even during full operation, and so it is possible to maintain the purification function for a long time.

The above and other objects, features, and advantages of the present invention will become more apparent from the following description when taken in conjunction with the accompanying drawings in which a preferred embodiment of the present invention is shown by way of illustrative example.

DESCRIPTION OF EMBODIMENTS

The following describes in detail examples of preferred embodiments of the present invention, while referencing the accompanying drawings.

First Embodiment

Figure 1:
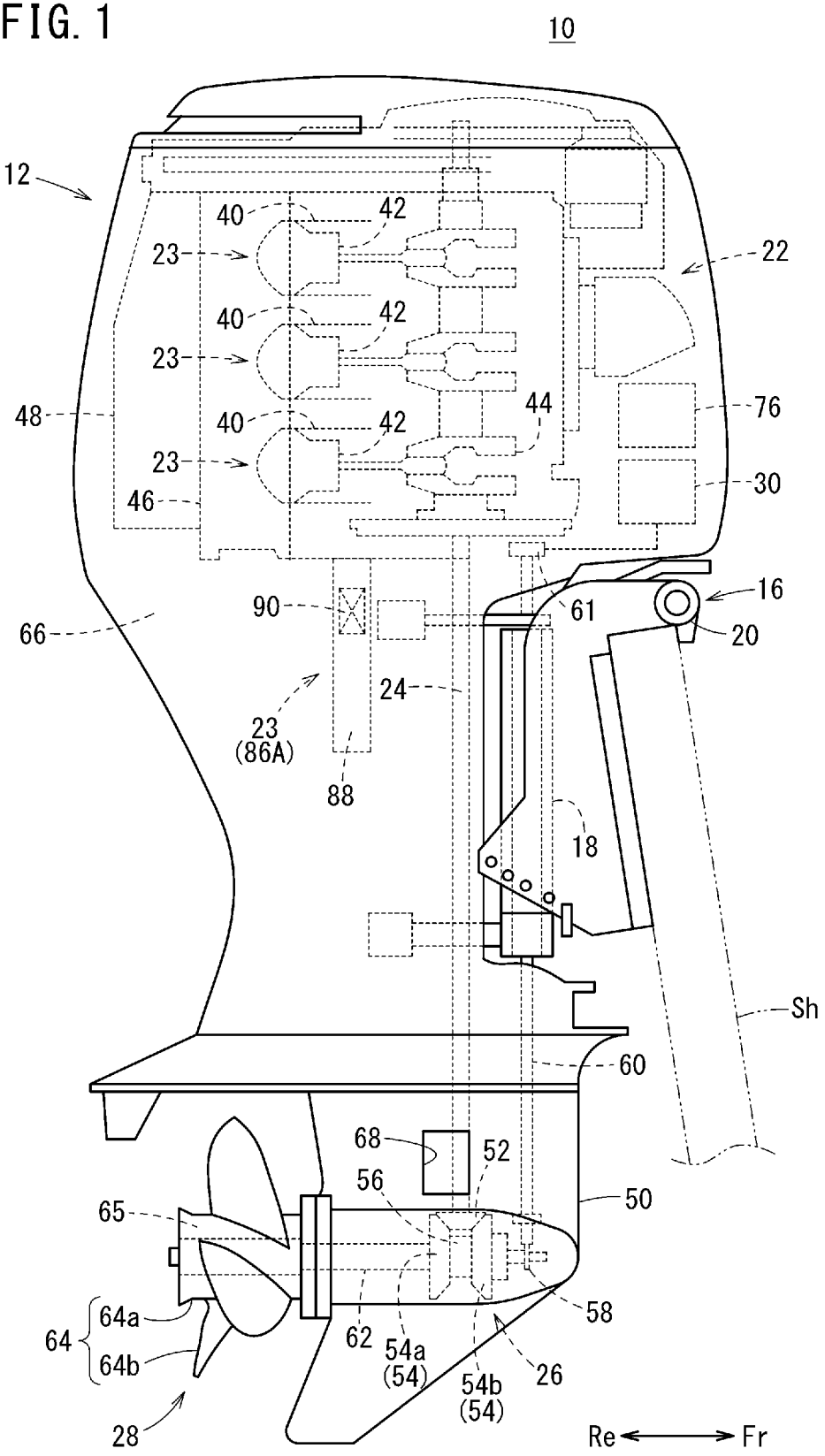
FIG. 1 is a side surface view showing an overall configuration of an outboard motor according to a first embodiment of the present invention.

As shown in FIG. 1, an outboard motor 10 according to a first embodiment of the present invention is attached to a ship body Sh, as a drive force source for a small-scale ship or the like, and causes the ship body Sh to progress by driving the ship body Sh according to a user operation. The outboard motor 10 includes a housing 12 that forms the outer view thereof and a mounting mechanism 16 that secures the outboard motor 10 to the ship body Sh at the front (in the direction of the arrow Fr) of the housing 12. The mounting mechanism 16 enables the housing 12 to swing left and right, centered on a swivel shaft 18, in a planar view, and enables the housing 12 including the swivel shaft 18 to rotate clockwise or counter-clockwise in FIG. 1, centered on a tilt shaft 20.

An engine 22 (internal combustion engine), a drive shaft 24, a gear mechanism 26, a propeller mechanism 28, and a control section 30 are housed inside the housing 12. Furthermore, an exhaust system 23 that causes the exhaust gas of the engine 22 to flow is provided at the bottom portion of the engine 22.

A vertical type of multi-cylinder engine (e.g. 3-cylinder engine) is adopted as the engine 22. The engine 22 includes three cylinders 40 having axial lines oriented laterally (substantially horizontally), in three rows in the up-down direction, and crankshafts 44 connected respectively to piston rods 42 of the respective cylinders 40 extend in the up-down direction. Furthermore, a cylinder block 46 and a cylinder head 48 of the engine 22 are provided with a cooled water jacket 22*a* (see FIG. 2A) that cools the engine 22.

A top end of the drive shaft 24 is connected to a bottom end portion of the crankshaft 44 of the engine 22. The drive shaft 24 extends in the up-down direction (vertical direction) within the housing 12, and is rotatable on an axis. The bottom end of the drive shaft 24 is housed in the gear mechanism 26.

The gear mechanism 26 includes a gear case 50 that is connected to an extension case (not shown in the drawings). A drive bevel gear 52 that is secured to the bottom end of the drive shaft 24, and driven bevel gears 54 (forward driven bevel gear 54*a* and reverse driven bevel gear 54*b*) that mesh with the drive bevel gear 52 and rotate in a direction orthogonal to the drive shaft 24, are provided inside the gear case 50. The gear mechanism 26 includes a dog clutch 56 capable of meshing with an inner toothed surfaces of the driven bevel gears 54 and a shift slider 58 that is connected to the dog clutch 56 via a connection bar (not shown in the drawings). The shift slider 58 extends in a manner to be movable back and forth inside a propeller shaft 62 of the propeller mechanism 28, which is described further below, and the end portion of the shift slider 58 on the forward side is exposed from the propeller shaft 62. The shift slider 58 has a groove in the exposed portion, and a cam portion (not shown in the drawings) of an operation shaft 60 that extends above the gear case 50 is inserted into this groove.

The top end of the operation shaft 60 is rotatably connected to a shift actuator 61, and the shift actuator 61 is driven according to a shift operation of the user. Specifically, by moving the shift slider 58 back and forth in the axial direction of the propeller shaft 62 due to the rotation of the operation shaft 60, the gear mechanism 26 moves the dog clutch 56 between the pair of driven bevel gears 54. Due to this, the toothed surface of the dog clutch 56 meshes with one of the inner toothed surface of the forward driven bevel gear 54*a* and the inner toothed surface of the reverse driven bevel gear 54*b*.

A propeller body 64 includes a cylindrical body 64*a* that surrounds the propeller shaft 62 on the radially outward side of the propeller shaft 62 and a plurality of fins 64*b* connected to the outer circumferential surface of the cylindrical body 64*a*. A through-hole 65 in communication with the space inside the gear case 50 is provided on the inner side of the cylindrical body 64*a*.

The outboard motor 10 configured in the manner described above transmits the rotational drive force of the crankshaft 44 of the engine 22 to the forward driven bevel gear 54*a* and the reverse driven bevel gear 54*b*, via the drive shaft 24 and the drive bevel gear 52. Furthermore, since the dog clutch 56 meshes with one of the inner toothed surface of the forward driven bevel gear 54*a* and the inner toothed surface of the reverse driven bevel gear 54*b*, the rotational drive force of one of these driven bevel gears 54 is transmitted to the propeller body 64 via the dog clutch 56 and the propeller shaft 62. Due to this, the propeller body 64 rotates clockwise or counter-clockwise with the propeller shaft 62 as the rotational center, and the ship body Sh moves backward or forward.

Furthermore, a cooling structure 66 that cools the exhaust gas of the engine 22 is provided inside the housing 12. In the present embodiment, the cooling structure 66 is configured to have a cooling system that cools the engine 22 by supplying the engine 22 with water (referred to below as cooling water) such as sea water or fresh water taken in from outside the housing 12. Therefore, a water intake port 68 for taking the cooling water into the housing 12 is formed on the bottom portion side of the housing 12 (above the gear mechanism 26).

The cooling structure 66 in the housing 12 is formed by layering and connecting a plurality of cases (mount bracket, oil case, upper separator and extension case, transom adjustment case, and the like, which are not shown in the drawings) in the up-down direction. The exhaust system 23 that causes the exhaust gas of the engine 22 to flow is installed inside this cooling structure 66.

Figure 2B:
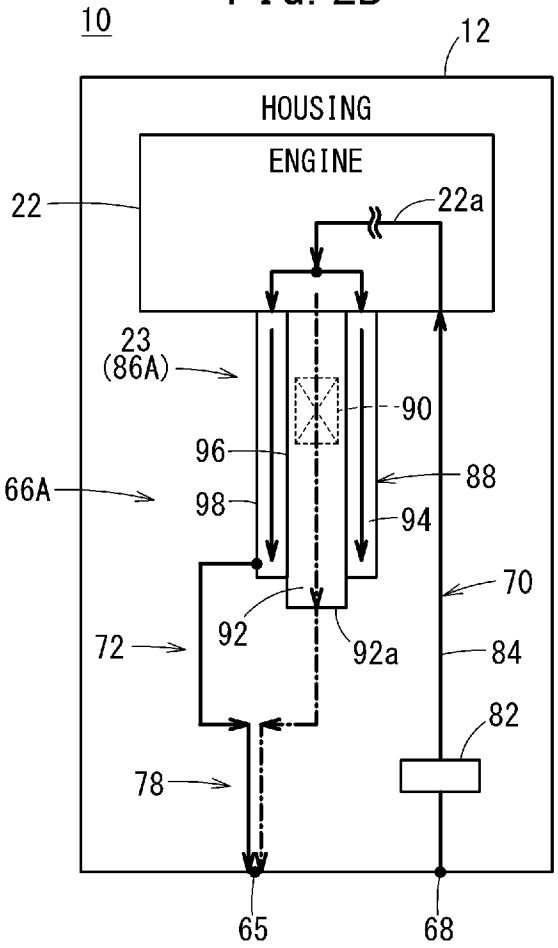
FIG. 2B is an explanatory diagram showing another example of a cooling structure of the outboard motor.
Figure 2A:
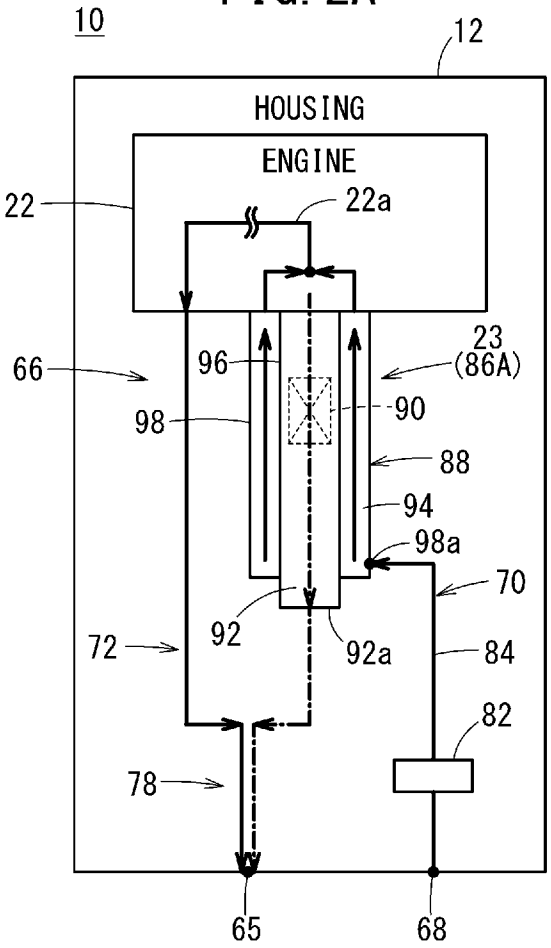
FIG. 2A is an explanatory diagram showing a cooling structure of the outboard motor.

As shown in FIG. 2A, the cooling structure 66 includes a cooling water inbound passage 70 that guides the cooling water (also referred to below as supplied cooling water) from the water intake port 68 to the engine 22, and a cooling water outbound passage 72 that guides the cooling water (also referred to below as discharged cooling water) that has cooled the engine 22. The cooling water inbound passage 70 includes the water intake port 68, a cooling water screen (not shown in the drawings) arranged near the water intake port 68 inside the housing 12, a water pump 82 provided above the cooling water screen, and a cooling water supply pipe 84 that is connected to the water pump 82. The water pump 82 sucks in the supplied cooling water via the water intake port 68, and causes the supplied cooling water to flow upward through the cooling water supply pipe 84.

The cooling water supply pipe 84 extends upward from the water pump 82, and the top end of the cooling water supply pipe 84 is in communication with the exhaust system 23. Therefore, the supplied cooling water that has flowed upward inside the cooling water supply pipe 84 is guided to the cooled water jacket 22*a* of the engine 22 through the exhaust system 23 to cool the engine 22. The configuration of this exhaust system 23 is described in detail further below.

On the other hand, the cooling water outbound passage 72 is formed of a discharge water passage inside a delivery pipe (not shown in the drawings) or a discharge water passage formed integrally inside each case. The cooling water that has cooled the engine 22 becomes discharged cooling water and flows downward through the discharge water passage inside the cooling structure 66. This discharged cooling water then mixes with exhaust gas inside a prescribed case to become a mixed fluid.

The mixed fluid (cooling water and exhaust gas) is guided to the through-hole 65 of the propeller body 64, through a mixed fluid passage 78 (respective spaces of the prescribed case, the gear case 50, and the like) inside the cooling structure 66. This mixed fluid is then basically discharged to the outside of the outboard motor 10, from the through-hole 65. Although not shown in the drawings, the cooling structure 66 may be provided with a sub exhaust gas passage (not shown in the drawings) that guides this exhaust gas to the outside of the outboard motor 10 based on a decrease in the amount of exhaust gas discharged from the through-hole 65 when the engine 22 is rotating at low speed (idling).

The exhaust system 23 of the engine 22 forms the range up to the point where the exhaust gas of the engine 22 mixes with the cooling water. Furthermore, an exhaust gas purification structure 86A of the outboard motor 10 is provided to this exhaust system 23 to purify the exhaust gas as it flows. This exhaust gas purification structure 86A is configured to include an exhaust gas pipe 88 that extends inside the cooling structure 66 and a catalyst 90 that is provided inside the exhaust gas pipe 88.

The exhaust gas pipe 88 is formed as a component that is separate from the case of the cooling structure 66, and is secured to the prescribed case, the engine 22, or the like by screws or the like. Alternatively, in the exhaust system 23, an exhaust gas pipe may be formed of wall portions formed integrally in a plurality of cases (or in one case).

The exhaust gas pipe 88 includes an exhaust gas passage 92 that causes the exhaust gas to flow downward and a coolant flow passage 94 that causes the supplied cooling water of the cooling water inbound passage 70 supplied from the cooling water supply pipe 84 to flow upward. The cooling structure 66 is not limited to a configuration that cools the exhaust gas using the supplied cooling water. For example, as shown in FIG. 2B, a cooling structure 66A may have a configuration to cool the exhaust gas using the discharged cooling water that has cooled the engine 22. In this case, a configuration is adopted in which the cooling water inbound passage 70 directly guides the supplied cooling water to the engine 22 through the cooling water supply pipe 84 or the inside of the prescribed case while the cooling water outbound passage 72 provides direct communication from the cooled water jacket 22*a* of the engine 22 to the coolant flow passage 94 of an outer pipe 98.

Figure 3B:
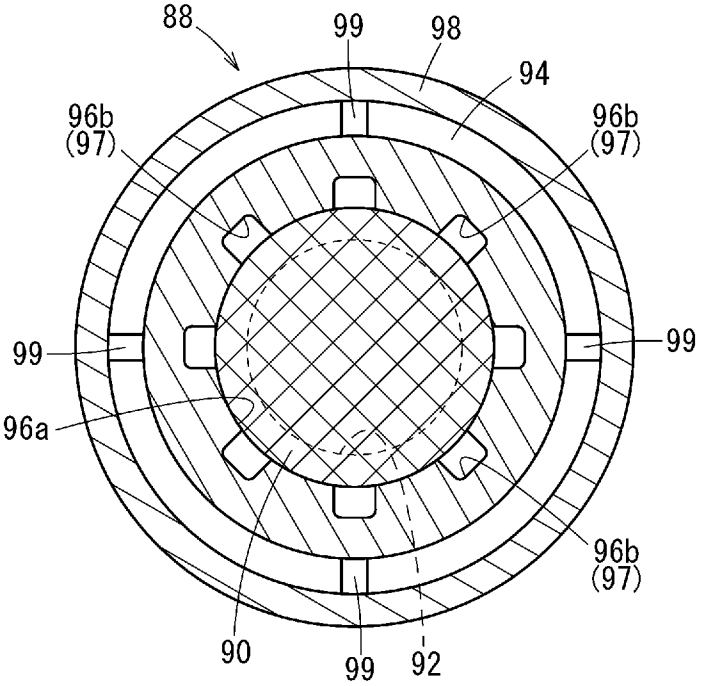
FIG. 3B is a cross-sectional view over the line IIIB-IIIB of FIG. 3A.
Figure 3A:
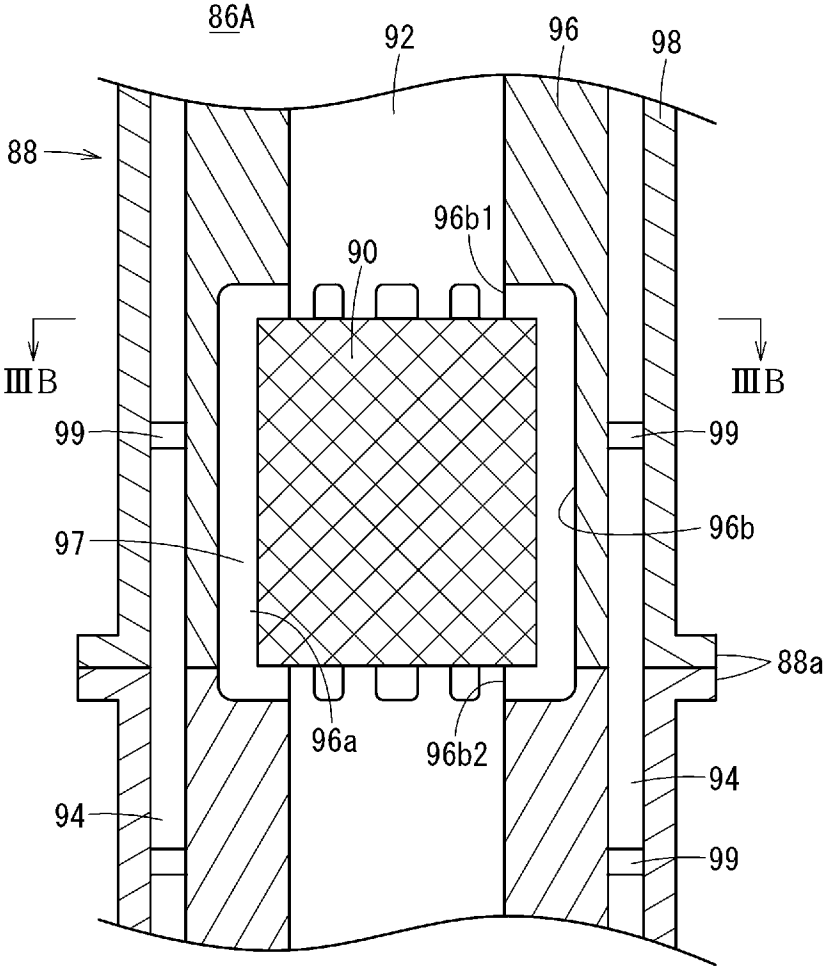
FIG. 3A is a side surface cross-sectional view of main components of an exhaust gas purification structure.

As shown in FIGS. 2A, 3A, and 3B, the exhaust gas pipe 88 has a double-pipe structure including an inner pipe 96 that forms the exhaust gas passage 92 and the outer pipe 98 that houses the inner pipe 96 and forms, between the outer pipe 98 and the inner pipe 96, a gap that forms the coolant flow passage 94. In other words, in the cooling structure 66 according to the present embodiment, the entire circumference of the exhaust gas passage 92 is surrounded by the coolant flow passage 94.

The inner pipe 96 is formed of a hard material such as a metal or resin material, and is secured inside the cooling structure 66. The inner surface of the inner pipe 96 forms the exhaust gas passage 92, and has a fluid path cross-sectional area that allows the exhaust gas to flow with a suitable exhaust pressure. The cross-sectional shape orthogonal to the axial direction of the inner pipe 96 is not particularly limited, and may be formed to be circular, polygonal, or the like.

The top end of the inner pipe 96 is connected to an exhaust gas discharge port inside the engine 22, via a connection pipe (not shown in the drawings) (or directly). The bottom end of the inner pipe 96 is arranged at a prescribed height position of the cooling structure 66 (e.g. the extension case). The bottom end of the inner pipe 96 is provided with an exhaust gas port 92*a* that is in communication with the exhaust gas passage 92 and expels the exhaust gas to the space inside the cooling structure 66.

The outer pipe 98 is formed to have a cross-sectional shape similar to that of the inner pipe 96, and to have a cross-sectional area larger than that of the inner pipe 96. By housing the inner pipe 96 inside the outer pipe 98, the coolant flow passage 94 is formed between the outer surface of the inner pipe 96 and the inner surface of the outer pipe 98. Furthermore, a rod-shaped holding body 99 that connects the inner pipe 96 and the outer pipe 98 to each other and maintains the gap (coolant flow passage 94) is provided between the inner pipe 96 and the outer pipe 98.

The top end of the outer pipe 98 is connected to the engine 22, via a connection pipe (not shown in the drawings) in communication with the cooled water jacket 22*a* of the engine 22 (or directly to the engine 22). The bottom end of the outer pipe 98 is closed off on the outside of the inner pipe 96, and the outer pipe 98 is provided with, at a prescribed position, an inflow port 98*a* to which the cooling water supply pipe 84 is connected. The supplied cooling water of the cooling water supply pipe 84 is supplied to the coolant flow passage 94 via this inflow port 98*a*.

The catalyst 90 of the exhaust gas purification structure 86A is installed at an intermediate position in the exhaust gas pipe 88. The catalyst 90 is formed with a cross-sectional shape (circular or polygonal) corresponding to the cross-sectional shape of the exhaust gas passage 92, and extends a prescribed length in the axial direction of the exhaust gas pipe 88. The catalyst 90 is housed inside the inner pipe 96 in an immobile manner.

The catalyst 90 is not particularly limited, and various components that purify exhaust gas can be adopted. For example, a three-way catalyst formed of a material such as platinum, palladium, or rhodium can be adopted as the catalyst 90. The three-way catalyst detoxifies the exhaust gas by converting hydrocarbons, carbon monoxide, and nitrogen oxides, which are the main harmful substances in the exhaust gas, into nitrogen, water, carbon dioxide, and the like through oxidation/reduction reactions.

The catalyst 90 is manufactured by immersing a catalyst carrier formed of ceramic or the like in a noble metal salt solution to fix (support) the noble metal particles onto the surface of the catalyst carrier, or by applying noble metal particles to a catalyst substrate, and this catalyst 90 is incorporated in the inner pipe 96. The catalyst carrier includes, on the inside thereof, a large number of cavities that extend in the axial direction of the exhaust gas pipe 88 and are in communication with the exhaust gas passage 92. The large number of cavities have a honeycomb structure, for example, and the exhaust gas reacts with the metal particles while the exhaust gas passes therethrough.

The exhaust gas pipe 88 is structured to hold the catalyst 90 described above with the inner pipe 96 and to divert a portion of the exhaust gas from the held catalyst 90. Specifically, the inner surface of the inner pipe 96 is provided with a recessed portion 96*a* and a plurality (eight in FIG. 3B) of groove portions 96*b* arranged along the circumferential direction of this recessed portion 96*a*.

Furthermore, the exhaust gas pipe 88 (inner pipe 96 and outer pipe 98) is configured to be separable in the axial direction in the vicinity of the recessed portion 96*a*, in order to accommodate the catalyst 90. Therefore, a separated end portion of the exhaust gas pipe 88 (the outer pipe 98) is provided with a flange 88*a* that connects the two pieces of the exhaust gas pipe 88 to each other with a suitable securing means (welding, adhesion, screwing, or the like).

The recessed portion 96*a* is formed by cutting out a shallow notch from the inner surface of the inner pipe 96 toward the outer side. The outer side of the recessed portion 96*a* (the notched portion of the inner surface of the inner pipe 96) is formed to have the same external shape as the catalyst 90 (same shape and same dimensions). Furthermore, the recessed portion 96*a* is formed with a length in the axial direction that is the same as the axial direction length of the catalyst 90. In other words, the recessed portion 96*a* is formed to include the exhaust gas passage 92 in the inner surface of the inner pipe 96 and to have the same shape as the catalyst 90, thereby holding the catalyst 90 to be immobile within the inner pipe 96.

The plurality of groove portions 96*b* are formed by cutting notches in the inner surface of the inner pipe 96 that extend farther outward than the recessed portion 96*a*, and extend linearly. The groove portions 96*b* are provided at uniform intervals along the circumferential direction of the recessed portion 96*a*, and extend parallel to each other along the axial direction of the inner pipe 96.

The axial direction length of each groove portion 96*b* is set to be greater than the axial direction length of the recessed portion 96*a*. Specifically, the top end portion of each groove portion 96*b* has a notch cut out farther upward than the top end of the recessed portion 96*a* to form a top end opening 96*b*1 in communication with the exhaust gas passage 92, and the bottom end portion of each groove portion 96*b* has a notch cut out farther downward than the bottom end of the recessed portion 96*a* to form a bottom end opening 96*b*2 in communication with the exhaust gas passage 92. Furthermore, the top end portion and the bottom end portion of each groove portion 96*b* are formed to have rounded angles between the groove floor and the respective top end opening 96*b*1 and bottom end opening 96*b*2.

In a state where the catalyst 90 is arranged in the recessed portion 96*a*, the outer surface of the catalyst 90 and the inner surface of the recessed portion 96*a* are in contact with each other. Therefore, the extension portion of each groove portion 96*b* is covered by the catalyst 90, while the top end opening 96*b*1 and the bottom end opening 96*b*2 of each groove portion 96*b* are in communication with the exhaust gas passage 92. Accordingly, in a state where the catalyst 90 is arranged, the groove portions 96*b* form a plurality of exhaust gas bypass passages 97 through which the exhaust gas of the exhaust gas passage 92 can flow. These exhaust gas bypass passages 97 restrict the reaction between the exhaust gas and the catalyst 90 by allowing the exhaust gas to flow without passing through the catalyst 90 (in a manner to bypass the catalyst 90).

The exhaust gas purification structure 86A of the outboard motor 10 according to the present embodiment is basically configured in the manner described above, and the following describes the operation thereof.

As shown in FIGS. 1 and 2A, when the engine 22 is operating, the cooling structure 66 of the outboard motor 10 uses the control section 30 to control the operation of the water pump 82, takes in the cooling water that is outside the outboard motor 10 (housing 12) through the water intake port 68, and guides the cooling water upward through the cooling water inbound passage 70. The supplied cooling water flows through the cooling water supply pipe 84 after passing through the cooling water screen and the water pump 82, and is guided to the exhaust gas pipe 88 of the exhaust system 23.

Figure 4:
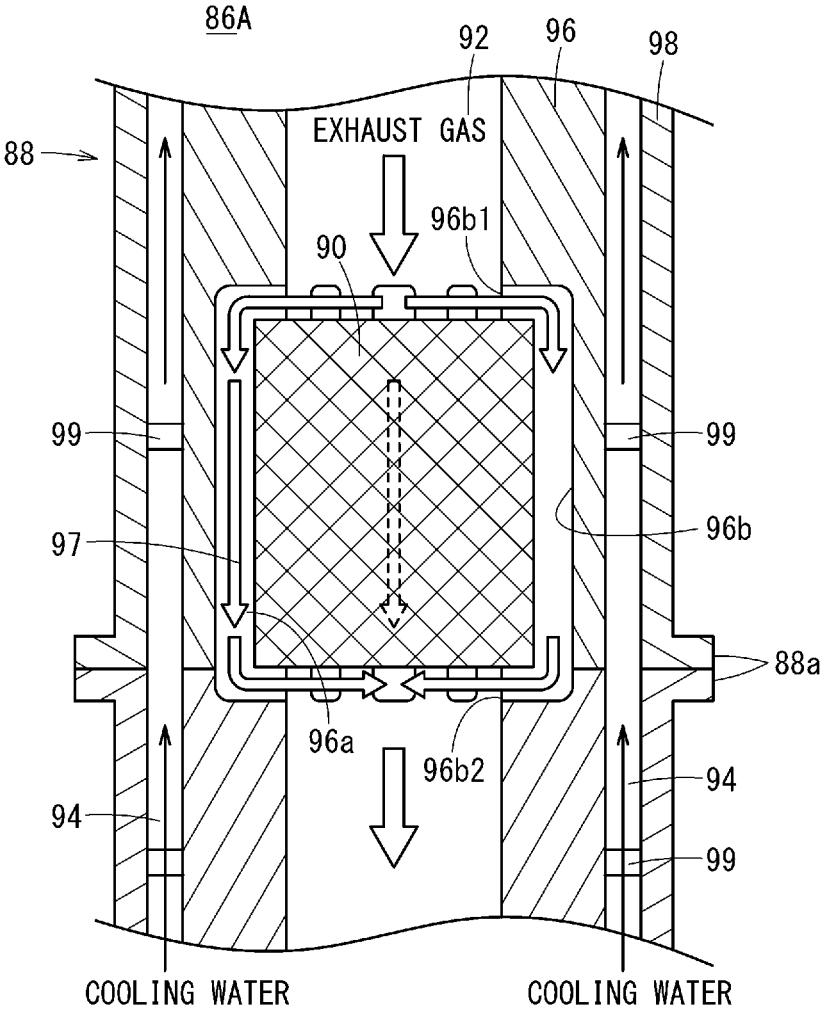
FIG. 4 is a side surface cross-sectional view showing the operations of the main components of the exhaust gas purification structure at a time when the outboard motor is operating.

As shown in FIG. 4, in the exhaust gas purification structure 86A, the exhaust gas pipe 88 has the double-pipe structure including the inner pipe 96 and the outer pipe 98, and the supplied cooling water is guided upward in a manner to surround the entire outer side of the inner pipe 96, by the coolant flow passage 94 of the outer pipe 98. Therefore, the supplied cooling water can cool the catalyst 90 and the exhaust gas of the exhaust gas passage 92. This supplied cooling water flows into the cooled water jacket 22*a* of the engine 22 from the coolant flow passage 94, and cools the engine 22 (see FIG. 2A). The cooling water that has cooled the engine 22 is guided below the cooling structure 66 from the engine 22, through the cooling water outbound passage 72, as discharged cooling water.

On the other hand, the exhaust gas of the engine 22 is discharged to the exhaust gas passage 92 of the exhaust gas pipe 88 (inner pipe 96) from the engine 22. This exhaust gas flows downward in the exhaust gas passage 92, and a portion of this exhaust gas flows into the catalyst 90.

Here, by cooling the area surrounding the catalyst 90 (inner pipe 96) with the supplied cooling water that flows through the coolant flow passage 94, the catalyst 90 is prevented from reaching a high temperature (e.g. reaching a temperature of 1000° C. or more). Therefore, the catalyst 90 can react with the exhaust gas at a suitable temperature (e.g. 800° C. to 900° C.) to purify the exhaust gas. Furthermore, by cooling the catalyst 90 as well as the engine 22 and the exhaust gas pipe 88 near the catalyst 90, it is possible for a worker to easily remove the catalyst 90 and perform suitable processing thereon when performing maintenance of the outboard motor 10 or the like.

Furthermore, the inner pipe 96 that holds the catalyst 90 forms the exhaust gas bypass passages 97 between the inner pipe 96 and the catalyst 90. Therefore, the exhaust gas purification structure 86A guides a portion of the exhaust gas in a manner to bypass the catalyst 90 and pass through the exhaust gas bypass passages 97. Accordingly, when the engine 22 is activated, even though the supplied cooling water flows through the coolant flow passage 94 surrounding the inner pipe 96, it is possible to increase the temperature of the catalyst 90 as much as possible with the exhaust gas, thereby improving the exhaust gas purification function. Furthermore, the exhaust gas bypass passages 97 can reduce deterioration of the catalyst 90 by not allowing the entire exhaust gas to pass therethrough, even during full operation of the outboard motor 10, and this can increase the lifetime of the catalytic performance of the catalyst 90. Yet further, the exhaust gas bypass passages 97 cause the exhaust gas that has passed through the bypass passages to be mixed together immediately at the bottom end of the catalyst 90, and therefore the structure of the exhaust gas passage 92 at locations other than where the catalyst 90 is held can be simplified.

The exhaust gas that has flowed through the exhaust gas passage 92 of the inner pipe 96 flows out in a downward direction from the exhaust gas port 92*a* of the inner pipe 96 and is mixed with the discharged cooling water of the cooling water outbound passage 72. The mixed fluid is formed in this way, and this mixed fluid flows through the mixed fluid passage 78 and is discharged to the outside of the outboard motor 10 from the through-hole 65.

The present invention is not limited to the embodiment described above, and various alterations can be made without deviating from the scope of the present invention. For example, various numbers and shapes of the exhaust gas bypass passages 97 (groove portions 96*b*) can be adopted to suitably adjust the temperature of the catalyst 90. The following describes several examples of other embodiments of the outboard motor 10 and exhaust gas purification structures 86A to 86D according to the present invention. In the following description, components that have the same function and configuration as components in the embodiment described above are given the same reference numerals, and detailed descriptions thereof are omitted.

Second Embodiment

Figure 5B:
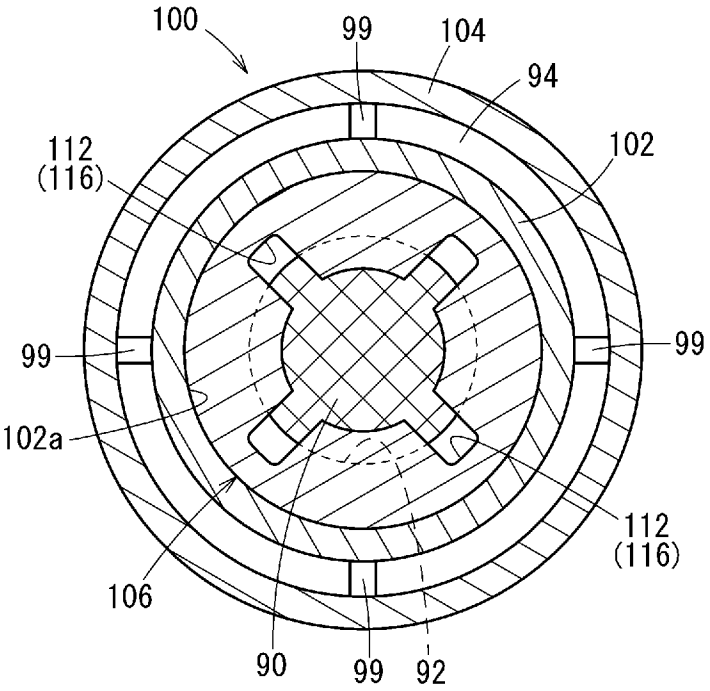
FIG. 5B is a cross-sectional view over the line VB-VB of FIG. 5A.
Figure 5A:
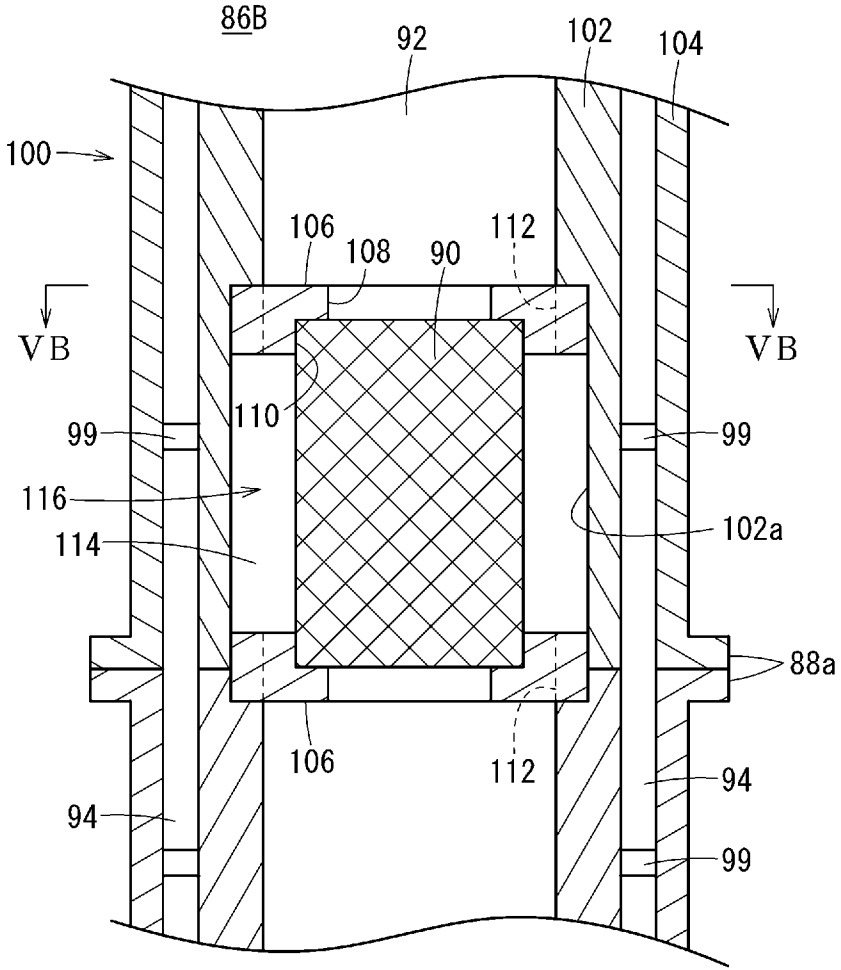
FIG. 5A is a side surface cross-sectional view of main components of an exhaust gas purification structure according to a second embodiment of the present invention.

As shown in FIGS. 5A and 5B, the exhaust gas purification structure 86B according to a second embodiment differs from the exhaust gas purification structure 86A described above by being configured to hold the catalyst 90 in an exhaust gas pipe 100 (inner pipe 102 and outer pipe 104) via a support frame 106 (support member).

The support frame 106 is formed with an annular shape having, in the center thereof, a communication opening 108 for passing the exhaust gas, in a planar view. This support frame 106 is attached to both axial direction ends (top and bottom ends in FIG. 5A) of the catalyst 90, which has a columnar shape. In other words, the catalyst 90 is held at a prescribed position in the inner pipe 102 via a pair of support frames 106. The material forming each support frame 106 is not particularly limited, but is preferably a material with higher heat transfer than the inner pipe 102, for example. In this way, it is possible to favorably cool the catalyst 90 with the cooling water flowing through the coolant flow passage 94 of the outer pipe 104, to prevent the catalyst 90 from reaching a high temperature.

A stepped portion 110 that enables an end portion of the catalyst 90 to be housed therein is provided to the inner surface of the support frame 106. By matching the surface of the stepped portion 110 to the outer surface of the catalyst 90, the support frame 106 firmly secures one end portion of the catalyst 90. This stepped portion 110 is in communication with the communication opening 108 on the inner side via the steps.

Furthermore, the support frame 106 includes a plurality (four in FIG. 5B) of notches 112 that extend radially from an inner edge forming the communication opening 108. The length of each notch 112 from the center point of the communication opening 108 to the extension end is greater than the radius of the catalyst 90. Therefore, in a state where the catalyst 90 is fitted with the stepped portion 110 of the support frame 106, the exhaust gas passage 92 of the inner pipe 102 is continuous via each notch 112. The width of each notch 112 should be set to a dimension suitable for achieving sufficient flow of the exhaust gas in the exhaust gas passage 92.

In the planar view, the outer sides of the respective support frames 106 are connected in the circumferential direction while closing off the notches 112. The shape of the outer side of each support frame 106 matches a recessed portion 102*a* formed in the inner pipe 102. Therefore, in a state where each support frame 106 is fitted in the inner pipe 102, each support frame 106 is secured in the recessed portion 102*a* of the inner pipe 102.

The recessed portion 102*a* formed in the inner surface of the inner pipe 102 of the exhaust gas purification structure 86B holds the catalyst 90 via the pair of support frames 106. Therefore, the inner surface of the recessed portion 102*a* has a notch cut outward from the inner surface of the inner pipe 102, and circulates annularly along the circumferential direction of the inner pipe 102. The axial direction length of the recessed portion 102*a* matches the axial direction length obtained by adding together the axial direction lengths of the catalyst 90 and the pair of support frames 106 fitted with the catalyst 90.

A gap 114 through which the exhaust gas can flow is formed between the outer surface of the catalyst 90 and the inner surface of the recessed portion 102*a*. In other words, the catalyst 90 and the inner pipe 102 form an exhaust gas bypass passage 116 through which the exhaust gas bypasses the catalyst 90 to the side thereof by the support frames 106. Specifically, the exhaust gas bypass passage 116 is formed of the gap 114 and the plurality of notches 112 provide to the pair of support frames 106.

The exhaust gas purification structure 86B according to the second embodiment is basically configured as described above. This exhaust gas purification structure 86B can also divert a portion of the exhaust gas of the exhaust gas passage 92 through the exhaust gas bypass passage 116, and can realize the same effect as the exhaust gas purification structure 86A. Furthermore, the exhaust gas purification structure 86B does not require that groove portions be provided in the inner surface of the inner pipe 102, thereby making it possible to simplify the manufacturing of the exhaust gas pipe 100 and reduce the manufacturing cost.

Third Embodiment

Figure 6:
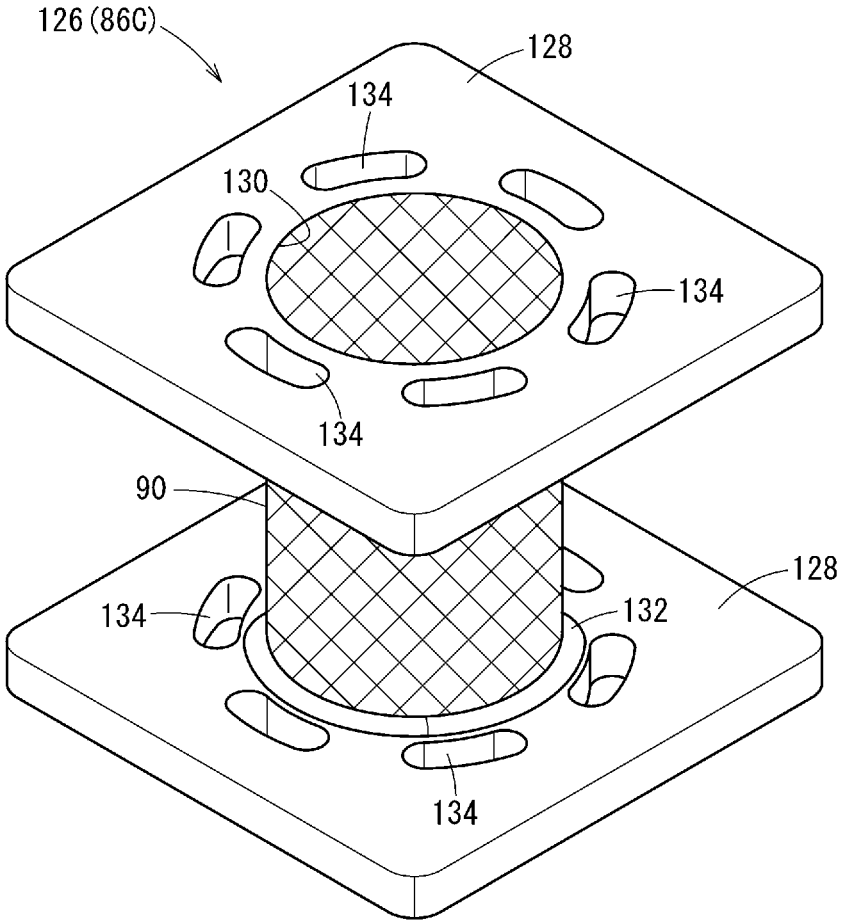
FIG. 6 is a perspective view of a catalyst cartridge of an exhaust gas purification structure according to a third embodiment of the present invention.
Figure 7B:
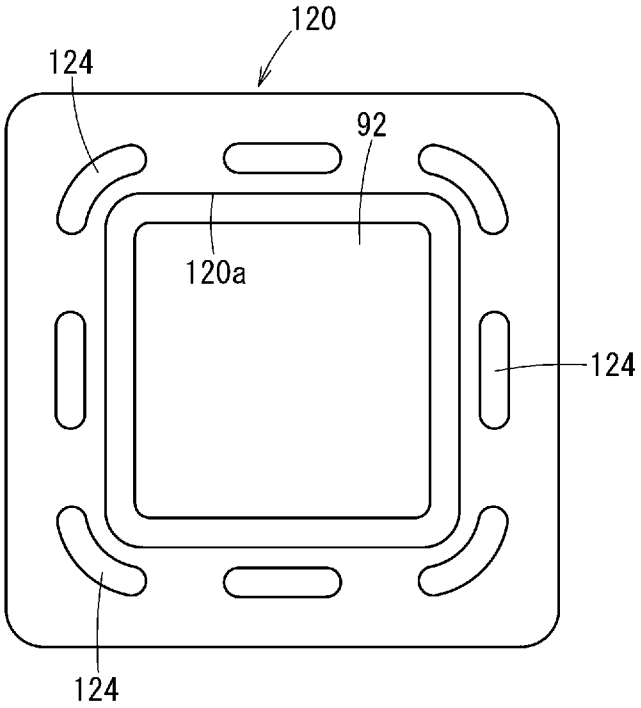
FIG. 7B is a cross-sectional view over the line VIIB-VIIB of FIG. 7A.
Figure 7A:
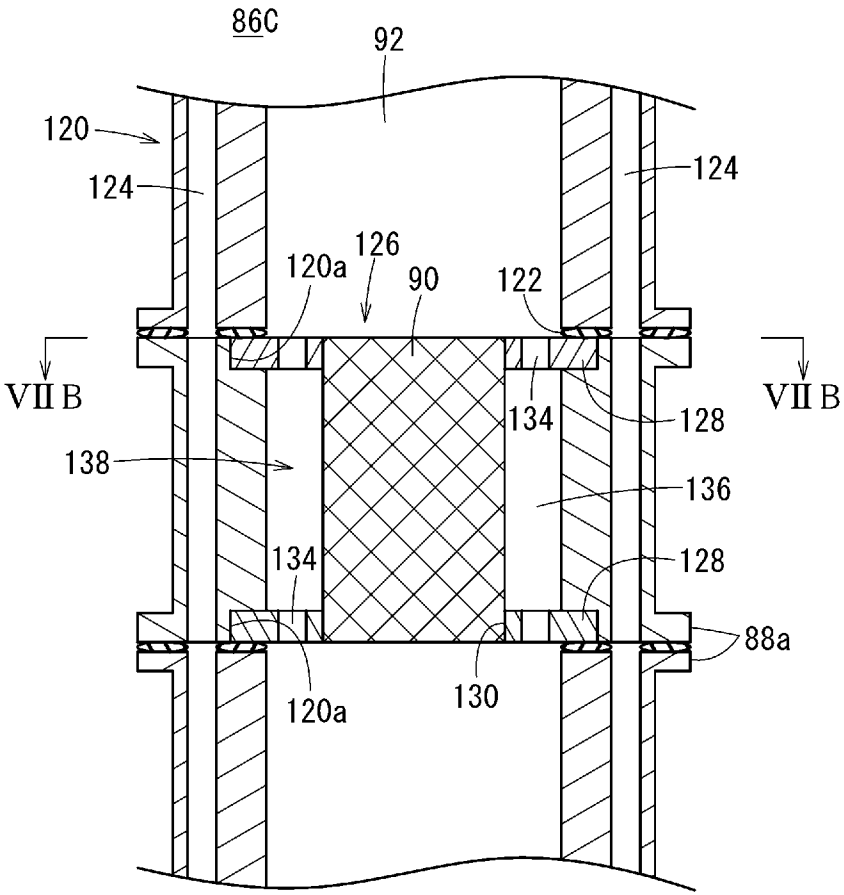
FIG. 7A is a side surface cross-sectional view of main components of the exhaust gas purification structure of FIG. 6.

As shown in FIGS. 6, 7A and 7B, the exhaust gas purification structure 86C according to a third embodiment differs from the exhaust gas purification structures 86A and 86B described above in that the catalyst 90 is configured as a cartridge and housed in an exhaust gas pipe 120. Specifically, the exhaust gas purification structure 86C includes a catalyst cartridge 126 that is formed of the catalyst 90 and a pair of support plates 128 (support members) attached respectively at the axial direction end portions of the catalyst 90. In the present embodiment, the exhaust gas pipe 120 is formed with a polygonal cylindrical shape, and the pair of support plates 128 are formed as quadrangular shapes in accordance with this.

The pair of support plates 128 house and hold the catalyst cartridge 126 in the exhaust gas pipe 120. A connection hole 130 into which the catalyst 90 is inserted is provided in a central portion of each support plate 128. The diameter of the connection hole 130 is set to be the same as the diameter of the catalyst 90. The hole edge of each support plate 128 forming the connection hole 130 is firmly secured to the side surface of the catalyst 90 inserted into the connection hole 130, using welding or the like, for example. Therefore, a welded portion 132 is formed between the catalyst 90 and the pair of support plates 128. The catalyst cartridge 126 can be formed by securing the catalyst 90 and the pair of support plates 128 to each other using, instead of welding, any one of fitting, screwing, and brazing.

A plurality (six in FIG. 6) of exhaust gas passages 134 that penetrate through the support plate 128 in the thickness direction are provided on the outside of the connection hole 130 in each support plate 128. Each exhaust gas passage 134 is formed with an arc shape whose curvature is less than that of the connection hole 130, and extends at a position distanced from the connection hole 130.

Each exhaust gas passage 134 faces (is in communication with) the exhaust gas passage 92 and allows the exhaust gas to pass therethrough, in a state where the catalyst cartridge 126 is housed in the exhaust gas pipe 120. Furthermore, in this housed state, the catalyst cartridge 126 forms a gap 136 between the pair of support plates 128 and also between the inner surface of the exhaust gas pipe 120 and the outer surface of the catalyst 90. This gap 136 is in communication with each exhaust gas passage 134. In other words, when the exhaust gas pipe 120 houses the catalyst cartridge 126, an exhaust gas bypass passage 138 is formed of the gap 136 and the exhaust gas passages 134 of the pair of support plates 128.

On the other hand, in order to arrange the catalyst cartridge 126 in the exhaust gas pipe 120, the exhaust gas pipe 120 is divided into three sections in the axial direction, and the catalyst cartridge 126 is arranged in the middle pipe among these sections. The divided pipes are connected by a suitable securing means (screwing, adhesion, or the like). Furthermore, packing 122 is arranged at each connection location of the divided pipes. The exhaust gas pipe 120 is formed to have a quadrangular cross-sectional shape, and is formed of a single pipe wall (i.e. as a structure that does not include an inner pipe and outer pipe). The cross-sectional shape of the exhaust gas pipe 120 is not limited to a quadrangular shape (i.e. to being formed with a polygonal cylindrical shape), and can obviously be formed with a circular cylindrical shape or the like.

The inner surface of the exhaust gas pipe 120 forms the exhaust gas passage 92. An engagement groove 120*a* that engages with the support plate 128 is formed in the inner surface of the exhaust gas pipe 120. The engagement groove 120*a* simplifies the arrangement of the catalyst cartridge 126 by being provided at a boundary of the divided pipes. A plurality (eight in FIG. 7B) of coolant flow passages 124 through which the cooling water for cooling the exhaust gas flows are provided inside the pipe wall of the exhaust gas pipe 120 on the outer side of the exhaust gas passage 92. The coolant flow passages 124 are long holes extending around the exhaust gas passage 92, and are provided at uniform intervals from each other. The coolant flow passages 124 extend parallel to each other along the axial direction of the exhaust gas pipe 120.

In a case where the exhaust gas pipe 120 is formed of the case of the cooling structure 66 as described above, a structure may be adopted in which a door (not shown in the drawings) capable of opening and closing the exhaust gas passage 92 is provided in a portion (the case) of the exhaust gas pipe 120 and the catalyst cartridge 126 is inserted and secured in a state where the door is open. Furthermore, this configuration can obviously be adopted in other embodiments as well.

The exhaust gas purification structure 86C according to the third embodiment is basically configured as described above. This exhaust gas purification structure 86C can also divert a portion of the exhaust gas of the exhaust gas passage 92 through the exhaust gas bypass passage 138, and can realize the same effect as the exhaust gas purification structure 86A. Furthermore, by forming the catalyst cartridge 126 in the exhaust gas purification structure 86C, the machining of the exhaust gas pipe 120 can be simplified and the manufacturing cost can be reduced.

Fourth Embodiment

Figure 8B:
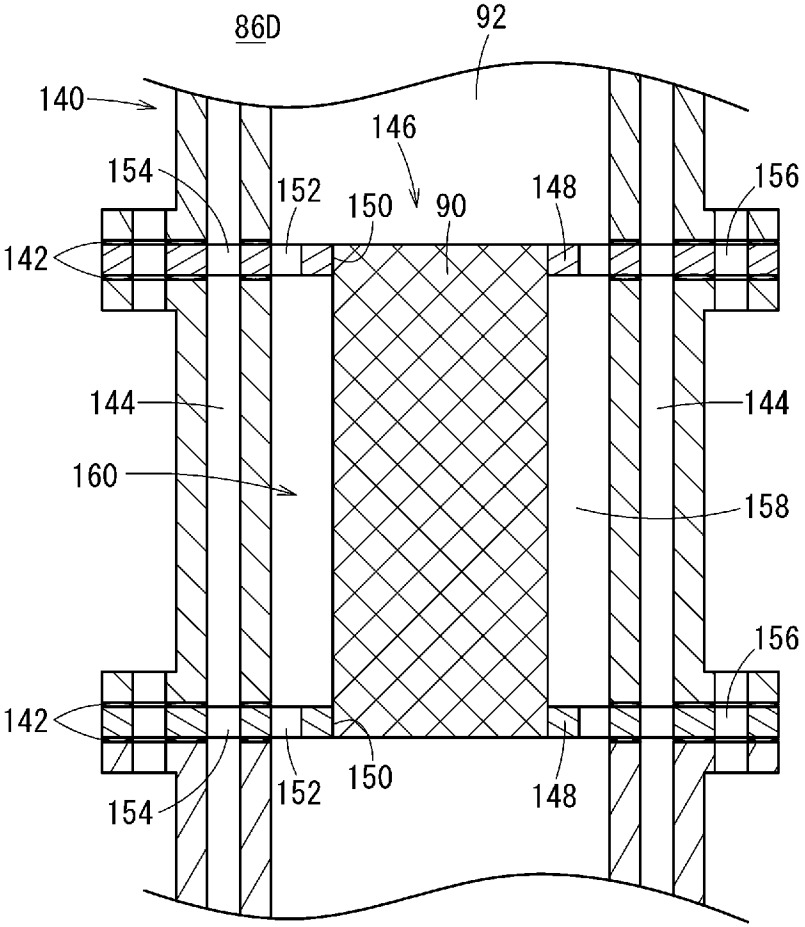
FIG. 8B is a side surface cross-sectional view of main components of the exhaust gas purification structure of FIG. 8A.
Figure 8A:
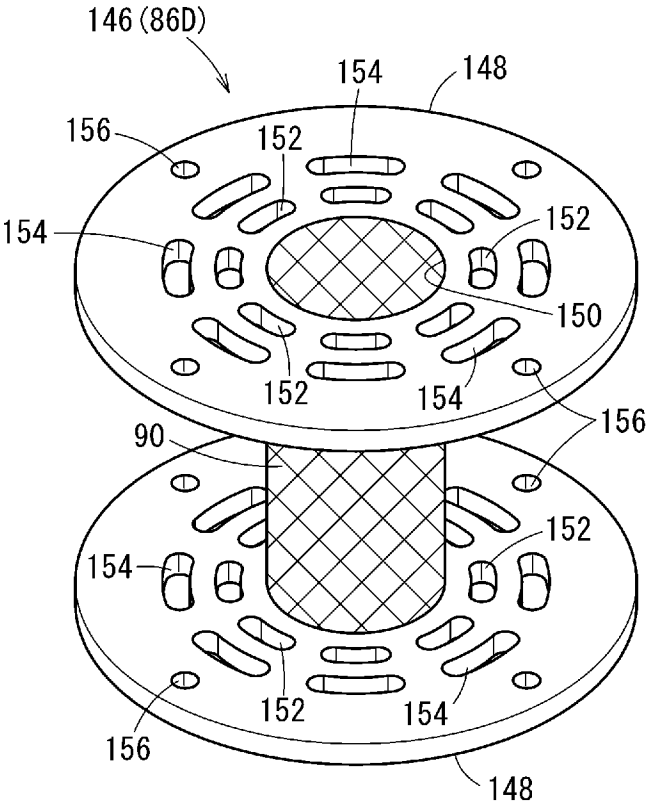
FIG. 8A is s a perspective view of a catalyst cartridge of an exhaust gas purification structure according to a fourth embodiment of the present invention.

As shown in FIGS. 8A and 8B, the exhaust gas purification structure 86D according to a fourth embodiment has a configuration in which a catalyst cartridge 146 is provided in an exhaust gas pipe 140, in the same manner as the exhaust gas purification structure 86C, but differs from the exhaust gas purification structure 86C in that a pair of support plates 148 of the catalyst cartridge 146 are provided with a connection hole 150, a plurality of exhaust gas passages 152, a plurality of cooling water communication passages 154, and a screw hole 156. In the present embodiment, the exhaust gas pipe 140 and the catalyst cartridge 146 are formed with circular shapes in the cross-sectional view.

On the other hand, the exhaust gas pipe 140 has a structure capable of being divided into three sections and these three divided pipes are connected, in the same manner as in the exhaust gas purification structure 86C. When connecting the divided pipes, the catalyst cartridge 146 is housed and held by sandwiching packing 142 and the pair support plates 148. Furthermore, the exhaust gas pipe 140 includes a plurality of coolant flow passages 144 on the outer side of the exhaust gas passage 92, in the same manner as in the exhaust gas purification structure 86C.

In a state where the catalyst cartridge 146 is arranged in the exhaust gas pipe 140, an exhaust gas bypass passage 160 is formed due to the plurality of exhaust gas passages 152 of the pair of support plates 148 being in communication with a gap 158 formed between the outer surface of the catalyst 90 and the inner surface of the exhaust gas pipe 140. Furthermore, each coolant flow passage 144 of the exhaust gas pipe 140 and each cooling water communication passage 154 of the catalyst cartridge 146 are in communication with each other via holes in the packing 142, and the cooling water can flow therethrough.

Accordingly, this exhaust gas purification structure 86D can also divert a portion of the exhaust gas of the exhaust gas passage 92 through the exhaust gas bypass passage 160, and can realize the same effect as the exhaust gas purification structures 86A to 86C. Furthermore, the exhaust gas purification structure 86D can further simplify the structure of the exhaust gas pipe 140 and reduce the manufacturing cost.

Fifth Embodiment

Figure 9:
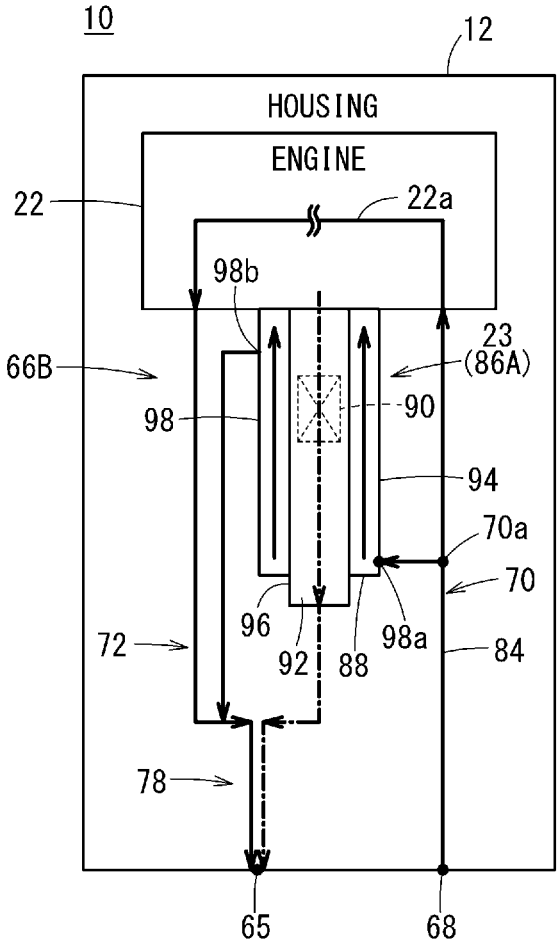
FIG. 9 is an explanatory diagram showing a cooling structure of the outboard motor according to a fifth embodiment.

As shown in FIG. 9, a cooling structure 66B according to a fifth embodiment differs from the cooling structures 66 and 66A described above in that the passage for the cooling water for cooling the exhaust gas of the exhaust gas pipe 88 and the passage for the cooling water headed toward the engine 22 are independent from each other. For example, the cooling water inbound passage 70 of the cooling structure 66B branches at a midway position (branch point 70*a*) in the cooling water supply pipe 84, to be in communication with the coolant flow passage 94 at the bottom end of the exhaust gas pipe 88. Furthermore, the coolant flow passage 94 is configured to discharge the cooling water from an outflow port 98*b* provided at the top end thereof, and to cause this cooling water to flow together with the discharged cooling water of the engine 22 at a midway position in the cooling water outbound passage 72.

When the cooling structure 66B is configured in this manner as well, it is possible to suitably adjust the temperature of the catalyst 90 with the exhaust gas purification structures 86A to 86D. In particular, by guiding the cooling water to the exhaust system 23 separately from the engine 22, it is possible to more efficiently cool the exhaust gas and the catalyst 90.

Sixth Embodiment

Figure 10B:
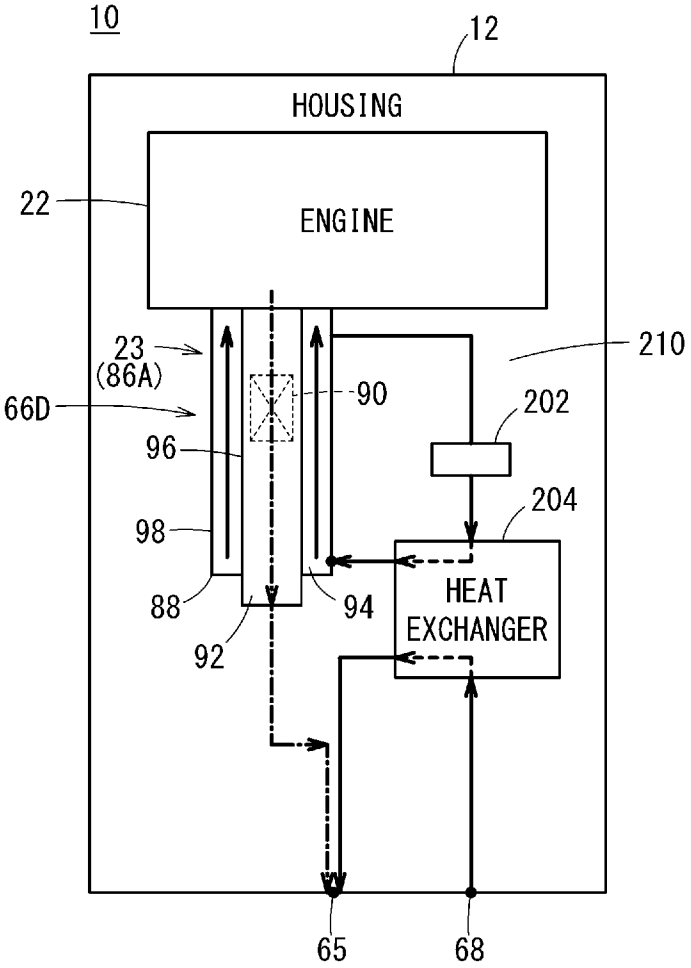
FIG. 10B is an explanatory diagram showing a cooling structure of the outboard motor according to a seventh embodiment.
Figure 10A:
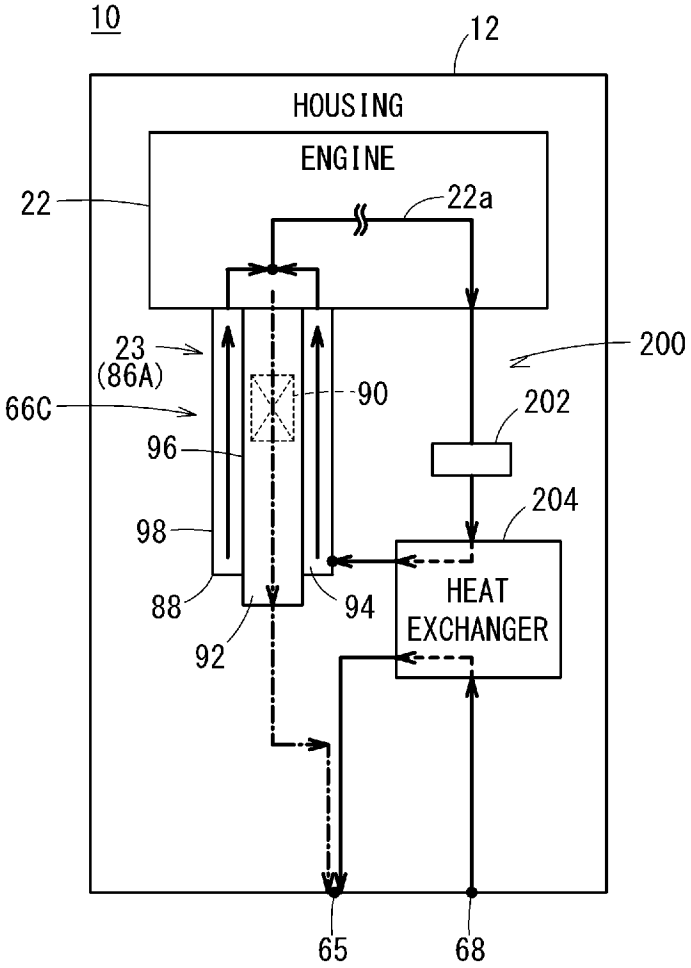
FIG. 10A is an explanatory diagram showing a cooling structure of the outboard motor according to a sixth embodiment.

As shown in FIG. 10A, a cooling structure 66C according to a sixth embodiment differs from the cooling structures 66, 66A, and 66B described above in that a cooling circulation passage 200 for cooling the engine 22 and the exhaust gas is provided independently inside the housing 12 (forming a closed loop). In this case, the cooling circulation passage 200 includes a pump 202 that circulates a coolant (oil, water, or the like) and a heat exchanger 204 that cools the coolant. The cooling circulation passage 200 is configured to, for example, return the coolant that has cooled the engine 22 to the heat exchanger 204, after the coolant has flowed through the coolant flow passage 94 of the exhaust gas pipe 88 and the cooled water jacket 22*a* of the engine 22 in the stated order.

The cooling structure 66C is configured to take in the cooling water from outside the housing 12 and guide this cooling water to the heat exchanger 204. In other words, the heat exchanger 204 is configured to cool the coolant using the cooling water taken in from outside. The configuration of the heat exchanger 204 is not particularly limited, and the heat exchanger 204 may have a structure provided with a heat sink that takes in outside atmosphere to cool the coolant, for example. Furthermore, the cooling water that has been used by the heat exchanger 204 to cool the coolant is mixed with the exhaust gas discharged from the exhaust gas pipe 88 and discharged to the outside of the housing 12.

With the outboard motor 10 configured in the manner described above as well, the exhaust gas pipe 88 and the catalyst 90 provided inside the exhaust gas pipe 88 can be cooled by the coolant, and the catalyst 90 can be prevented from reaching a high temperature. Furthermore, with the outboard motor 10, since the cooling water can be restricted from contacting the exhaust gas pipe 88, it is possible to prevent deterioration (corrosion) of the exhaust gas pipe 88 and the catalyst 90.

Seventh Embodiment

As shown in FIG. 10B, a cooling structure 66D according to a seventh embodiment differs from the cooling structures 66 and 66A to 66C described above in that a cooling circulation passage 210 causes the coolant to flow only through the exhaust gas pipe 88, and does not cause the coolant to flow to the engine 22. Specifically, the cooling circulation passage 210 forms a closed-loop cooling system that is independent from the cooling system for cooling the engine 22. By configuring the cooling circulation passage 210 in this way, it is possible to more efficiently cool the exhaust gas and the catalyst 90.

The following describes the technical ideas and effects that can be understood from the embodiments described above.

By providing the coolant flow passage 94, 124, or 144 in the exhaust gas pipe 88, 100, 120, or 140, the exhaust gas purification structures 86A to 86D can favorably cool the catalyst 90 and the exhaust gas flowing through the exhaust gas pipe 88, 100, 120, or 140. Accordingly, during maintenance or the like, a worker can easily touch the engine 22 or the exhaust gas pipe 88, 100, 120, or 140 near the catalyst 90, easily remove the cooled catalyst 90, and smoothly perform assembly. Therefore, it is possible to increase the degree of freedom in the layout of the catalyst 90.

By including the exhaust gas bypass passage 97, 116, 138, or 160 in the exhaust gas purification structures 86A to 86D, the catalyst 90 is efficiently heated by the surrounding exhaust gas even when the coolant (cooling water) flows through the exhaust gas pipe 88, 100, 120, or 140 when the internal combustion engine (engine 22) is activated. Accordingly, the catalyst 90 is quickly raised to a temperature suitable for purification of the exhaust gas. Furthermore, the exhaust gas bypass passage 97, 116, 138, or 160 can reduce deterioration of the catalyst 90 by not allowing the entire exhaust gas to pass even during full operation, and so it is possible to maintain the purification function for a long time.

The exhaust gas pipe 88 or 100 includes the inner pipe 96 or 102 having, on the inner side thereof, the exhaust gas passage 92, and the outer pipe 98 or 104 that houses the inner pipe 96 or 102 and forms the coolant flow passage 94 between the outer pipe 98 or 104 and the inner pipe 96 or 102, and the coolant flow passage 94 is formed around the entire outer surface the inner pipe 96 or 102. Therefore, the coolant flowing through the coolant flow passage 94 can more efficiently cool the catalyst 90 and the exhaust gas flowing through the exhaust gas passage 92 inside the inner pipe 96 or 102.

The inner surface of the exhaust gas pipe 88 forming the exhaust gas passage 92 includes the recessed portion 96*a* that holds the catalyst 90, and the exhaust gas bypass passage 97 includes the groove portion 96*b* provided in the inner surface of the recessed portion 96*a*. Therefore, the exhaust gas purification structure 86A can stably hold the catalyst 90 in the recessed portion 96*a* within the exhaust gas pipe 88, and can also divert the exhaust gas through the groove portion 96*b*.

Further, the support member (support frame 106 or support plate 128 or 148) is provided that supports the catalyst 90 and is secured to the exhaust gas pipe 100, 120, or 140, and the support member forms the gap 114, 136, or 158, which forms the exhaust gas bypass passage 116, 138, or 160, between the inner surface of the exhaust gas pipe 100, 120, or 140 forming the exhaust gas passage 92 and the outer surface of the catalyst 90. In this way, by adopting the support member, the exhaust gas purification structures 86B to 86D can prevent the structure in the exhaust gas pipe 100, 120, or 140 from becoming complicated, thereby reducing the manufacturing costs. Furthermore, by simply securing the support member to the exhaust gas pipe 100, 120, or 140, it is possible to easily form the exhaust gas bypass passage 116, 138, or 160 (gap 114, 136, or 158) on the outer side of the catalyst 90.

Furthermore, the support member (support frame 106 or support plate 128 or 148) includes the exhaust gas passing section (notch 112 or exhaust gas passage 134 or 152) that forms the exhaust gas bypass passage 116, 138 or 160 and that is in communication with the exhaust gas passage 92 and the gap 114, 136, or 158 to allow the exhaust gas to pass therethrough. Therefore, even if complex machining is not applied to the exhaust gas pipe 100, 120, or 140, in the exhaust gas purification structures 86B to 86D, the catalyst 90 can be secured to the exhaust gas pipe 100, 120, or 140. Then, it is possible to favorably form the exhaust gas bypass passage 116, 138, or 160 with the exhaust gas passing section and the gap 114, 136, or 158.

The support member (support frame 106 or support plate 128 or 148) is provided at least at one axial direction end of the catalyst 90, protrudes outward from the catalyst 90, and is secured to the exhaust gas pipe 100, 120, or 140. Therefore, the exhaust gas purification structures 86B to 86D can realize a non-contact state in which the catalyst 90 does not contact the exhaust gas pipe 100, 120, or 140, and it is possible for the catalyst 90 to be heated more quickly when the engine 22 is activated.

The catalyst 90 and the support member (support plate 128 or 148) are secured to each other through any one of fitting, screwing, welding, and brazing, thereby forming the catalyst cartridge 126 or 146. Therefore, since the catalyst 90 and the support member are reliably formed integrally, the handling thereof becomes easier. Furthermore, it is possible to easily attach the catalyst cartridge 126 or 146 to the exhaust gas pipe 120 or 140.

The exhaust gas pipe 88, 100, 120, or 140 can be divided in the axial direction and the catalyst 90 can be inserted from the divided portion of the exhaust gas pipe and secured, or portions of the exhaust gas pipe 88, 100, 120, or 140 are capable of opening and closing and the catalyst 90 is inserted and secured in a state where the exhaust gas pipe 88, 100, 120, or 140 is open. Therefore, the exhaust gas purification structures 86A to 86D can more easily incorporate the catalyst 90 in the exhaust gas pipe 88, 100, 120, or 140.

The outboard motor 10 includes the cooling structures 66 and 66B that each cool the exhaust gas by taking in cooling water serving as the coolant through the water intake port 68 and guiding this cooling water to the exhaust gas pipe 88. Therefore, the outboard motor 10 can easily cool the catalyst 90 and the exhaust gas inside the exhaust gas pipe 88 using the cooling water taken in through the water intake port 68.

The cooling structure 66B includes the passage for cooling the internal combustion engine (engine 22) and the passage for cooling the exhaust gas pipe 88 independently from each other. Therefore, the cooling structure 66B can more easily cool the catalyst 90 and the exhaust gas inside the exhaust gas pipe 88.

The outboard motor 10 includes the cooling circulation passage 200 or 210 that cools the exhaust gas pipe 88 by circulating the coolant inside the housing 12. In this way, even in a configuration where the exhaust gas pipe 88 is cooled by the cooling circulation passage 200 or 210, it is possible to easily cool the catalyst 90 and the exhaust gas inside the exhaust gas pipe 88.

The cooling circulation passage 200 or 210 includes, in the passage where the coolant circulates, the heat exchanger 204 that cools the coolant, and the outboard motor 10 takes in the cooling water through the water intake port 68 and cools the coolant by guiding this cooling water to the heat exchanger 204. Therefore, the outboard motor 10 can sufficiently cool the coolant in the cooling circulation passage 200 or 210 with the heat exchanger 204, and can more efficiently cool the catalyst 90 and the exhaust gas of the exhaust gas pipe 88.

The invention claimed is:

1. An exhaust gas purification structure of an outboard motor, the exhaust gas purification structure comprising:

an exhaust gas pipe including an exhaust gas passage through which exhaust gas of an internal combustion engine is allowed to flow;

a catalyst provided in the exhaust gas passage and configured to purify the exhaust gas by allowing the exhaust gas to pass through an inside thereof;

a coolant flow passage being provided in the exhaust gas pipe, allowing a coolant that cools the exhaust gas to flow therethrough and surrounding the catalyst;

a holding place for the catalyst being formed on an inner side of the exhaust gas pipe and being in contact with an outer surface of the catalyst to hold the catalyst; and an exhaust gas bypass passage being formed between the coolant flow passage and the outer surface of the catalyst, and allowing the exhaust gas to flow without passing through the catalyst, wherein the holding place for the catalyst, at both opposed ends thereof, includes a circular communication opening to expose an end portion of the catalyst, and a plurality of passages being disposed outside the communication opening at intervals in a circumferential direction of the communication opening and establishing communication between the exhaust gas bypass passage and the exhaust gas passage.

2. The exhaust gas purification structure according to claim 1, wherein the exhaust gas pipe includes an inner pipe having the exhaust gas pipe on an inner side thereof, and an outer pipe that houses the inner pipe and forms the coolant flow passage between the outer pipe and the inner pipe, and the coolant flow passage is formed around an entire outer surface of the inner pipe.

3. The exhaust gas purification structure according to claim 1, wherein the inner surface of the exhaust gas pipe forming the exhaust gas passage includes a recessed portion configured to hold the catalyst, and the exhaust gas bypass passage includes a groove portion provided in an inner surface of the recessed portion.

4. The exhaust gas purification structure according to claim 1, further comprising:

a support member that is configured to support the catalyst and is secured to the exhaust gas pipe, wherein the support member forms a gap, which forms the exhaust gas bypass passage, between the inner surface of the exhaust gas pipe forming the exhaust gas passage and an outer surface of the catalyst.

5. The exhaust gas purification structure according to claim 4, wherein the support member includes an exhaust gas passing section that forms the exhaust gas bypass passage and that is in communication with the exhaust gas passage and the gap to allow the exhaust gas to pass therethrough.

6. The exhaust gas purification structure according to claim 5, wherein the support member is provided at least at one axial direction end side of the catalyst, protrudes outward from the catalyst, and is secured to the exhaust gas pipe.

7. The exhaust gas purification structure according to claim 5, wherein the catalyst and the support member form a catalyst cartridge by being secured to each other through any one of fitting, screwing, welding, and brazing.

8. The exhaust gas purification structure according to claim 1, wherein the exhaust gas pipe has a structure in which the exhaust gas pipe is configured to be divided in an axial direction and the catalyst is inserted from a divided portion of the exhaust gas pipe and secured, or a structure in which a portion of the exhaust gas pipe is configured to open and close and the catalyst is inserted and secured in a state where the exhaust gas pipe is open.

9. An outboard motor comprising an exhaust gas purification structure, the exhaust gas purification structure comprising:

an exhaust gas pipe including an exhaust gas passage through which exhaust gas of an internal combustion engine is allowed to flow; and a catalyst provided in the exhaust gas passage and configured to purify the exhaust gas by allowing the exhaust gas to pass through an inside thereof, a coolant flow passage being provided in the exhaust gas pipe, allowing a coolant that cools the exhaust gas to flow therethrough and surrounding the catalyst;

a holding place for the catalyst being formed an inner side of the exhaust gas pipe and being in contact with an outer surface of the catalyst to hold the catalyst; and an exhaust gas bypass passage being formed between the coolant flow passage and the outer surface of the catalyst and allowing the exhaust gas to flow without passing through the catalyst, the outboard motor further comprising a cooling structure configured to take in, through a water intake port, cooling water serving as the coolant, and cool the exhaust gas by guiding the cooling water to the exhaust gas pipe, and the holding place for the catalyst, at both opposed ends thereof, including a circular communication opening to expose an end portion of the catalyst, and a plurality of passages being disposed outside the communication opening at intervals in a circumferential direction of the communication opening and establishing communication between the exhaust gas bypass passage and the exhaust gas passage.

10. The outboard motor according to claim 9, wherein the cooling structure includes a passage configured to cool the internal combustion engine and a passage configured to cool the exhaust gas pipe independently from each other.

11. An outboard motor comprising an exhaust gas purification structure, the exhaust gas purification structure comprising:

an exhaust gas pipe including an exhaust gas passage through which exhaust gas of an internal combustion engine is allowed to flow; and a catalyst provided in the exhaust gas passage and configured to purify the exhaust gas by allowing the exhaust gas to pass through an inside thereof, a coolant flow passage being provided in the exhaust gas pipe, allowing a coolant that cools the exhaust gas to flow therethrough and surrounding the catalyst;

a holding place for the catalyst being formed an inner side of the exhaust gas pipe and being in contact with an outer surface of the catalyst to hold the catalyst; and an exhaust gas bypass passage being formed between the coolant flow passage and the outer surface of the catalyst and allowing the exhaust gas to flow without passing through the catalyst, the outboard motor further comprising a cooling circulation passage configured to cool the exhaust gas by circulating the coolant inside a housing, and the holding place for the catalyst, at both opposed ends thereof, including a circular communication opening to expose an end portion of the catalyst, and a plurality of passages being disposed outside the communication opening at intervals in a circumferential direction of the communication opening and establishing communication between the exhaust gas bypass passage and the exhaust gas passage.

12. The outboard motor according to claim 11, wherein the cooling circulation passage includes, in a passage through which the coolant circulates, a heat exchanger configured to cool the coolant, and the outboard motor takes in cooling water through a water intake port and cools the coolant by guiding the cooling water to the heat exchanger.

* * * * *